US006881040B2

(12) United States Patent
Hattori et al.

(10) Patent No.: US 6,881,040 B2
(45) Date of Patent: Apr. 19, 2005

(54) MULTI-STAGE SCREW COMPRESSOR UNIT ACCOMMODATING HIGH SUCTION PRESSURE AND PRESSURE FLUCTUATIONS AND METHOD OF OPERATION THEREOF

(75) Inventors: Toshiro Hattori, Tokyo (JP); Katsuyuki Takahashi, Tokyo (JP); Kiyoshi Tanaka, Tokyo (JP)

(73) Assignee: Mayekawa Mfg. Co., Ltd., Tokyo (JP)

( * ) Notice: Subject to any disclaimer, the term of this patent is extended or adjusted under 35 U.S.C. 154(b) by 62 days.

(21) Appl. No.: 10/386,112

(22) Filed: Mar. 12, 2003

(65) Prior Publication Data

US 2003/0215336 A1 Nov. 20, 2003

Related U.S. Application Data

(63) Continuation-in-part of application No. 09/783,133, filed on Feb. 15, 2001, now Pat. No. 6,659,729.

(51) Int. Cl.[7] ..... F04B 49/00
(52) U.S. Cl. ..... 417/53; 417/282
(58) Field of Search ..... 417/12, 53, 282, 417/299; 60/39, 281; 62/117; 418/1

(56) References Cited

U.S. PATENT DOCUMENTS 4,149,827 A * 4/1979 Hofmann, Jr. ..... 417/12
4,544,333 A * 10/1985 Hirano ..... 417/299
4,548,549 A * 10/1985 Murphy et al. ..... 417/53
4,609,329 A * 9/1986 Pillis et al. ..... 417/282
4,812,110 A * 3/1989 Kubo et al. ..... 418/1
5,606,853 A * 3/1997 Birch et al. ..... 60/39.281

* cited by examiner

*Primary Examiner*—Thor Campbell
(74) *Attorney, Agent, or Firm*—Crowell & Moring LLP

(57) ABSTRACT

A multi-stage screw compressor unit and method of operation thereof are provided, which enable operation with high efficiency always even when suction or discharge pressure fluctuates widely, the compressor unit comprising a combination of a compression stage provided with an unloader slide valve and that provided with an internal volume ratio control valve, or a combination of compression stage provided with an internal volume control valve and that of fixed internal volume ratio, or a combination of compression stages each provided with an internal volume control valve.

9 Claims, 6 Drawing Sheets

(A)

(B)

MULTI-STAGE SCREW COMPRESSOR UNIT ACCOMMODATING HIGH SUCTION PRESSURE AND PRESSURE FLUCTUATIONS AND METHOD OF OPERATION THEREOF

CROSS-REFERENCE TO RELATED APPLICATION

This application is a continuation-in-part of U.S. application Ser. No. 09/783,133 filed on Feb. 15, 2001, now U.S. Pat. No. 6,659,729.

BACKGROUND OF THE INVENTION

1. Field of the Invention

The present invention relates to a multi-stage screw compressor unit suitable for applications in the case the suction pressure or discharge pressure fluctuates widely when used for compressing and supplying gas for a refrigerating machine, air conditioner, gas turbine booster, natural gas pipe line, chemical process, spherical holder, etc. and the method of operation thereof.

2. Description of the Related Art

Capacity controllable screw compressors have been used widely for refrigerating machines. A plurality of compressors have been connected to compress gas through a plurality of stage, for example, two stages or three stages to reduce the compression ratio per one stage for improving compression efficiency, for polytropic efficiency is low if it is intended to attain high compression ratio (ratio of discharge pressure to suction pressure) by a single-stage compressor. As initial cost increases when a plurality of compressors are simply connected, compound compressor units in which a lower and a higher pressure stages are provided in a compressor unit driven by a driving machine have been prevailing to reduce initial cost.

Generally, in a screw compressor, the internal volume ratio is determined in the design stage, and a compressor of proper internal volume ratio is selected among compressor specifications of low, intermediate, and high compression ratio depending on uses. The selected compressor achieves maximum polytropic efficiency under a certain operating condition, i.e. at a certain compression ratio, and plytropic efficiency decreases at compression ratios other than that. This is for the wasteful work needed to be done when the compressor is operating at the compression ratio other than the compression ratio corresponding to the internal volume ratio of the selected compressor, because a pressure difference is developed between the pressure in the discharge space and that of the gas to be discharged into said space from the compression space formed by a pair of rotors of the compressor.

Screw compressors capable of manually adjusting internal volume ratio with the operation of compressor stopped are widely used, and there are also screw compressors capable of automatically adjusting internal volume ratio, but generally a screw compressor is provided with an unloader valve for varying the volume of the gas to be sucked, so its structure inevitably becomes complicated if the function of adjusting internal volume ratio is added. Therefore, generally, the internal volume ratio of a screw compressor provided with an unloader slide valve for controlling gas flow rate is not controllable, and it is difficult to always attain high polytropic efficiency. As mentioned above, the internal volume ratio of a screw compressor is selected or manually adjusted with the compressor stopped or rarely automatically controlled.

FIG. 6 illustrates schematically the general structure of a conventional screw compressor. In the drawing, as a male rotor 12 and a female rotor (not shown in the drawing) meshing with the male rotor rotate, gas is sucked from an inlet port 15 into the space formed by the meshing tooth faces of both rotors and the inner peripheral wall of a rotor casing 14 (hereafter said space is referred to as the space between teeth). As the rotors rotate, the volume of the space between teeth increases, for the meshing line of the tooth faces moves toward the discharge side. When said volume becomes maximum, the communication of the space between teeth with the inlet port is shut off, so the space between teeth is closed, and the sucked gas is enclosed in the space between teeth.

As the rotors rotate further, the meshing lines of tooth faces (preceding and succeeding seal lines of tooth tips) move toward the discharge side, the volume of the enclosed space between teeth reduces, and the gas therein is compressed. When the tooth tips of both rotor (in FIG. 6, only the tooth tip of the male rotor is shown) reach the beginning edge 17*c* of the cut-off part 17*b* formed in the discharge side of an unloader slide valve 17 (actually, the beginning edge 17*c* consists of two beginning edge lines each parallel to the tooth tips of the male and female rotors), the enclosed space between teeth communicates to a discharge port 16, and the gas in the enclosed space is discharged as the rotors rotate.

Internal volume ratio is the ratio of the maximum enclosed space between teeth volume to the volume of the enclosed space just before the beginning of discharge.

Capacity control of varying the flow rate of gas of the screw compressor is effected by sliding the unloader slide valve 17 which straddles the perimeters of the male rotor 12 and female rotor (not shown in the drawing) to form a part of the internal wall surface of the rotor casing 14. A slide valve stopper 20 which is configured such that it forms a part of the internal wall surface of the rotor casing 14 similarly as the unloader slide valve 17, is provided at the suction side.

When the unloader slide valve 17 is moved to left so that its right end 17*a* comes to a location shown by a chain line 17*a*', a gap is developed between the right end 17*a*' of the unloader slide valve and the stopping face 19 of the slide valve stopper 20. As a result, the space between teeth is communicated with the inlet port 15 by way of a passage (not shown in the drawing) communicating with the inlet port 15, and the gas in the space between teeth is returned to the inlet port side as the rotors rotate.

The space between teeth moves toward the discharge side as the rotors rotate and compression of the gas in the space between teeth begins when it is shut off by the right end 17*a*' of the unloader slide valve 17. That is, the beginning of compression is controlled by the position of said right end 17*a*'. Therefore, the more the unloader slide valve is moved toward left, the lesser the flow rate of the gas becomes.

The conventional compound compressor consisting of stages of a lower and a higher pressure stage, each stage being composed to have a concentric axis of rotation and provided with an unloader slide valve, is often operated with the unloader slide valve of the higher pressure stage fixed always at 100% load position, i.e. at maximum flow rate position except when starting the compressor. Compound compressors like this have been used in many cases with low suction pressure and high compression ratio.

The compound compressor like this can be operated with high efficiency under constant high compression ratio condition, but when the compressor is operated with decreased compression ratio due to increased suction pressure or decreased discharge pressure, the operation condition of each of the low and high pressure stages deviates from the condition with which maximum efficiency is achieved. As a result, the compressor is operated with decreased efficiency and bearing load may increases resulting in decreased bearing life.

The lower pressure stage compresses sucked gas at the compression ratio corresponding with the design internal volume ratio determined in the design stage of the lower pressure stage and discharges the compressed gas to the inlet side of the higher pressure stage.

The higher pressure stage compresses the gas discharged from the lower pressure stage at the compression ratio corresponding with the design internal volume ratio determined in the design stage of the higher pressure stage.

Therefore, the suction pressure of the higher pressure stage (intermediate pressure) depends on the ratio of the volume of the enclosed space between teeth of the lower pressure stage when discharge from the space begins to the volume of the enclosed space between teeth of the higher pressure stage when compression begins, i.e. the volume of the maximum enclosed space between teeth of the higher pressure stage.

To be more specific, if the volume of the enclosed space between teeth of the lower pressure stage when discharge begins is smaller than the volume of the enclosed space between teeth of the higher pressure stage when compression begins, the gas discharged from the lower pressure stage is enclosed in the space between teeth which is larger than the space between teeth of the lower pressure stage when discharge begins, so that the pressure of the gas when compression begins in the higher pressure stage is lower than that when discharged from the lower pressure stage. That is, the intermediate pressure (suction pressure of the higher pressure stage) becomes lower than the discharge pressure of the lower pressure stage. Therefore, the gas discharged from the lower pressure stage expands in the space between the lower pressure stage and higher pressure stage, that means that the lower pressure stage compressed the gas excessively high and did wasteful compression work, resulting in decreased efficiency of the lower pressure stage.

Now if we call the ratio (the volume of the enclosed space between teeth of the lower pressure stage when discharge begins)/(the volume of the enclosed space between teeth of the higher pressure stage when compression begins) as displacement ratio, the smaller the displacement ratio, the lower the intermediate pressure becomes.

Said displacement ratio is different depending on the combination of specifications of the lower and higher pressure stages.

As mentioned before, generally the unloader slide valve of the higher pressure stage may often be fixed at the maximum capacity, i.e. at the maximum flow rate of gas. In this case, when the flow rate of gas of the lower pressure stage is decreased by capacity control, i.e. by adjusting the position of the unloader slide valve, the suction pressure of the higher pressure stage (intermediate pressure) decreases, for the more the flow rate is decreased, the smaller the displacement ratio becomes.

The discharge pressure of a screw compressor is $(Vi)^m$ times the suction pressure, where Vi is internal volume ratio, and m is polytropic exponent. Assuming polytropic exponent m is 1.3, when design internal volume ratio is 2.5, discharge pressure is 3.29 for suction pressure of 1.0, 4.94(=3.29×1.5) for suction pressure of 1.5, and 6.58(=3.29×2) for suction pressure of 2. If these discharge pressure of the lower pressure stage are the suction pressure of the higher pressure stage, and assuming polytropic exponent m is 1.3 and design internal volume ratio is 2.5 also in the higher pressure stage, discharge pressure of the higher pressure stage is 10.8, 16.2, and 21.6 for suction pressure of the lower pressure stage of 1, 1.5, and 2 respectively.

As described above, when the suction pressure of the lower pressure stage increases, the discharge pressure of the higher pressure stage increases considerably, and there happens the case that the discharge pressure exceeds the limit pressure permissible for the higher pressure stage.

When the displacement ratio is small, the intermediate pressure, i.e. the suction pressure of the higher pressure stage becomes lower than the discharge pressure of the lower pressure stage (the pressure in the enclosed space between teeth just before discharge begins), but even so, the discharge pressure of the higher pressure stage may happen to exceed the permissible pressure when suction pressure (the suction pressure of the lower pressure stage) is highly increased. The larger the design internal volume ratio is, the stronger this tendency is.

The reduction in efficiency at decreased flow rate can be evaded if the unloader slide valve of the higher pressure stage is controlled together with that of the lower pressure stage, but it is difficult to accommodate the fluctuation of suction pressure, despite that the controlling becomes complicated. To be more specific, the apprehension that particularly the discharge pressure of the higher pressure stage becomes excessively high when suction pressure increases can not be dismissed and that enough compression pressure can not be attained when suction pressure decreases.

By solving the problem mentioned above, a multi-stage screw compressor unit with two stages of a lower pressure stage and a higher pressure stage integrated can be provided, which can be operated always with high efficiency.

SUMMARY OF THE INVENTION

The present invention was made in light of the problem mentioned above, and the object is to provide a multi-stage compound screw compressor unit which is adapted to the application with big fluctuations in suction pressure or discharge pressure and can be operated always with high efficiency.

To solve the problem, the present invention provide a compressor unit in use for accommodating fluctuation of suction and discharge pressure, the compressor being composed as a two-stage compound compressor in which the lower and the higher pressure stages have the same axis of rotation, wherein the lower pressure stage is provided with an unloader slide valve or an internal volume ratio control valve capable of varying internal volume ratio from near 1.0 to the ratio corresponding to required discharge pressure, the higher pressure stage is provided with an internal volume ratio control valve capable of varying internal volume ratio from near 1.0 to the ratio corresponding to required discharge pressure or is of constant internal volume ratio, and the driving machine of said compressor is of variable rotation speed or of constant rotation speed depending on applications.

It is preferable that the higher pressure stage is provided with an internal volume ratio control valve capable of varying internal volume ratio from near 1.0 to the ratio corresponding to required discharge pressure when the lower pressure stage is provided with an unloader slide valve.

In this case, capacity control, i.e. gas flow rate control is performed by the unloader slide valve provided in the lower pressure stage, and compression ratio is controlled by the internal volume ratio control valve provided in the higher pressure stage. It is preferable that the internal volume ratio control valve is composed so that internal volume ratio is decreased to near 1.0, according to the art disclosed in the specification of U.S. application Ser. No. 09/783,133 by the present applicant.

In the higher pressure stage provided with the internal volume ratio control valve, capacity control is not done, only internal volume ratio is controlled.

The internal volume ratio control valve is configured such that it has a cut-out part formed toward the end of discharge side, and is located so that its suction side end face is not allowed to move into the rotor room beyond the suction side end face of the rotor. Said control valve can control internal volume ratio from near 1.0 to the ratio corresponding to required discharge pressure.

The composition like this is suited when suction pressure is high or fluctuates with discharge pressure nearly constant, because required discharge pressure can be secured by controlling the internal volume ratio of the higher pressure stage even when suction pressure varies depending on use or fluctuates during operation. When suction pressure decreases, the control valve is moved to increase the internal volume ratio of the higher pressure stage, and when suction pressure increases, the control valve is moved to decrease the internal volume ratio of the higher pressure stage. The problem mentioned before in the case of a conventional two-stage compound screw compressor that the bearings particularly of the higher pressure stage are damaged or reduced in life due to excessively high pressure in the higher pressure stage is evaded.

It is preferable that the compressor unit of which the higher pressure stage is provided with an internal volume ratio control valve capable of varying internal volume ratio from near 1.0 to the ratio corresponding to required discharge pressure is provided with a calculation part which calculates polytropic exponent according to operation conditions such as the kind of gas, pressure and temperature of gas, and rotation speed and determines the internal volume ratio with which polytropic efficiency is maximum, and a control part for moving the internal volume ratio control valve to the position with which polytropic efficiency is maximum and fix the valve there.

It is preferable to compose so that the rotation speed of the driving machine is controllable and to perform capacity control by controlling the rotation speed when capacity is to be controlled in a wide range, because if all of the wide range of capacity is controlled by the unloader slide valve of the lower pressure stage, too high or too low compression pressure in the space between teeth of the lower pressure stage at the beginning of discharge therefrom is resulted, and the efficiency of the lower pressure stage is decreased. With this composition, capacity control can be performed by capacity control of the lower pressure stage when flow rate does not change in wide ranges, and by rotation speed control when flow rate changes in wide ranges.

It is suitable to compose the compressor unit such that the lower pressure stage is of constant internal volume ratio when the higher pressure stage is provided with an internal volume ratio control valve capable of varying internal volume ratio from near 1.0 to the ratio corresponding to required discharge pressure, and the driving machine is of variable rotation speed so that capacity control is performed by controlling the rotation speed. This composition is also suited when suction pressure is high or fluctuates with discharge pressure nearly constant. For the fluctuation of suction pressure, the compressor unit can be adapted by controlling the internal volume ratio of the lower pressure stage. Overload particularly in the higher pressure stage can be evaded by this composition similarly as the case of the composition described before. Further, it is also suitable that the compressor unit is composed such that each of the lower and higher pressure stages is provided with an internal volume ratio control valve capable of varying internal volume ratio from near 1.0 to the ratio corresponding to required discharge pressure, and the driving machine is of variable rotation speed so that capacity control is performed by controlling the rotation speed. This composition is suited when suction and discharge pressures fluctuate and when discharge pressure fluctuates with suction pressure nearly constant or high. Capacity control is performed by controlling the rotation speed.

An inverter motor or an engine with transmission gearbox may be used for the driving machine. Particularly, by using an inverter motor which controls rotation speed by varying frequencies, continuous, stepless control of the flow rate of gas is possible.

It is also suitable to compose a multi-stage compressor unit such that a single or a plurality of single-stage or two-stage compressors are provided between the discharge port of the lower pressure stage and the suction port of the higher pressure stage of the two-stage compound compressor of the present invention. In this case, said single-stage compressor and two-stage compressor may be of constant internal volume ratio. These compositions are suitable when suction pressure is very low, for example, when applied in use for vacuum pomp.

When the radial bearings are used in a screw compressor, oil film formation is difficult when rotation speed is extremely reduced for decreasing the flow rate of gas, and continuous operation under this condition may induce wear and tear or damage of the bearings. Therefore, it is preferable, in order to evade continuous operation at low rotation speed lower than a certain speed, that the compressor unit is composed such that the discharge port of the higher pressure stage is connected with the suction port of the lower stage by way of a bypass control valve. By this, the control of the flow rate of gas can be performed by controlling said bypass control valve when rotation speed control is not proper.

Since the internal volume ratio of the compression stage provided with the internal volume ratio control valve can be decreased to near 1.0, starting torque of the compressor unit can be reduced by starting with the internal volume ratio control valve moved to the position with which internal volume ratio is minimum near 1.0. After the start, the internal volume ratio control valve is controlled so that pollytropic efficiency is at maximum. By this, the occurrence of event is evaded that starting is impossible due to excessive torque needed for starting.

DETAILED DESCRIPTION OF THE PREFFERED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
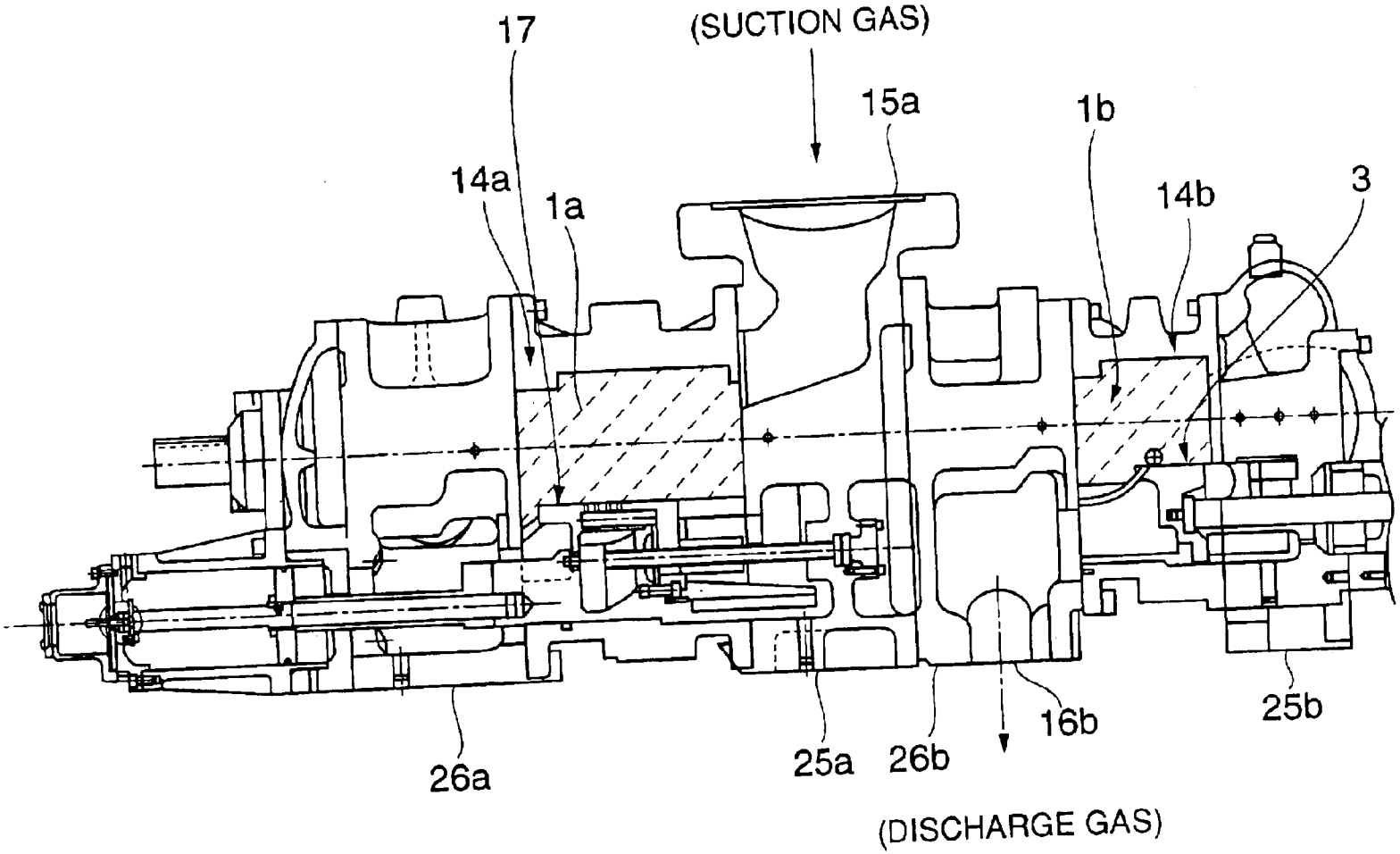
FIG. 1 is a longitudinal sectional view of the 2-stage compound screw compressor for accommodating the fluctuations in suction and discharge pressure according to the present invention.

FIG. 1 is a longitudinal sectional view including parts not sectioned of the 2-stage compound screw compressor for accommodating the fluctuations in suction and discharge pressure according to the present invention.

In the drawing, a lower pressure stage rotor 1*a* and a higher pressure stage rotor 1*b* are located in a lower pressure stage rotor casing 14*a* and a higher pressure stage rotor casing 14*b* respectively, both the rotors having the same axis of rotation. Both the rotors may be composed to have a common single rotor shaft or composed such that the shaft of the lower pressure stage rotor is connected concentric with that of the higher pressure stage rotor by a coupling.

A mating rotor not shown in the drawing is provided to mesh with each of said rotors to make a pair of rotors, and each pair of rotors constitutes each pressure stage.

The teeth of both rotors are formed or both the rotors are connected so that the discharge quantity vs. rotation angle curve of the lower pressure stage coincides or nearly coincides in phase with that of the higher pressure stage.

Reference numeral 25*a* is a suction side bearing housing of the lower pressure stage, which is provided with bearings (not shown in the drawing) for supporting the lower pressure stage rotors and has a suction port 15*a*. Reference numeral 26*a* is a discharge side bearing housing of the lower pressure stage, which is provided with bearings (not shown in the drawing) for supporting the lower pressure stage rotors and has a discharge port (not shown in the drawing).

The gas compressed in the lower pressure stage is sucked from the suction port 15*b* (see FIG. 2) of the higher pressure stage by way of an intermediate passage 50 (see FIG. 3), then compressed for the second time in the higher pressure stage 1*b* to be discharged from the discharge port 16*b* of the higher pressure stage. Reference numeral 25*b* is a suction side bearing housing of higher pressure stage, which is provided with bearings (not shown in the drawing) for supporting the higher pressure stage rotors and has a suction port 15*b* (see FIG. 2). Reference numeral 26*b* is a discharge side bearing housing of the higher pressure stage, which is provided with bearings (not shown in the drawing) for supporting the higher pressure stage rotors and has a discharge port 16*b*.

The lower pressure stage is provided with an unloader slide valve 17, and gas flow rate can be varied by sliding the valve 17 in the longitudinal direction of the rotor shaft. Gas flow rate decreases as the unloader slide valve 17 is moved toward left in FIG. 1.

The higher pressure stage is provided with an internal volume ratio control valve 3, and internal volume ratio can be varied by moving the control valve 3 in the longitudinal direction of the rotor shaft. Internal volume ratio increases as the control valve 3 is moved toward left in FIG. 1.

The gas sucked from the suction port 15*a* of the suction side bearing housing 25*a* is compressed in the lower pressure stage to be discharged from the discharge port (not shown in the drawing) of the discharge side bearing housing 26*a*, and introduced through an intermediate passage (not shown in the drawing) into the higher pressure stage from the suction port 15*b* of the suction side bearing housing 25*b* of the higher pressure stage, then further compressed in the higher pressure stage to be discharged from the discharge port 16*b* of the discharge side bearing housing 26*b* of the higher pressure stage.

A driving part for moving said unloader slide valve 17 is discernible at the lower-left side of the discharge side bearing housing 26*a* of the lower pressure stage in FIG. 1. A driving part (not shown in the drawing) for moving said internal volume ratio control valve is provided at the lower-right side of the suction side bearing housing 25*b* of the higher pressure stage.

Figure 2:
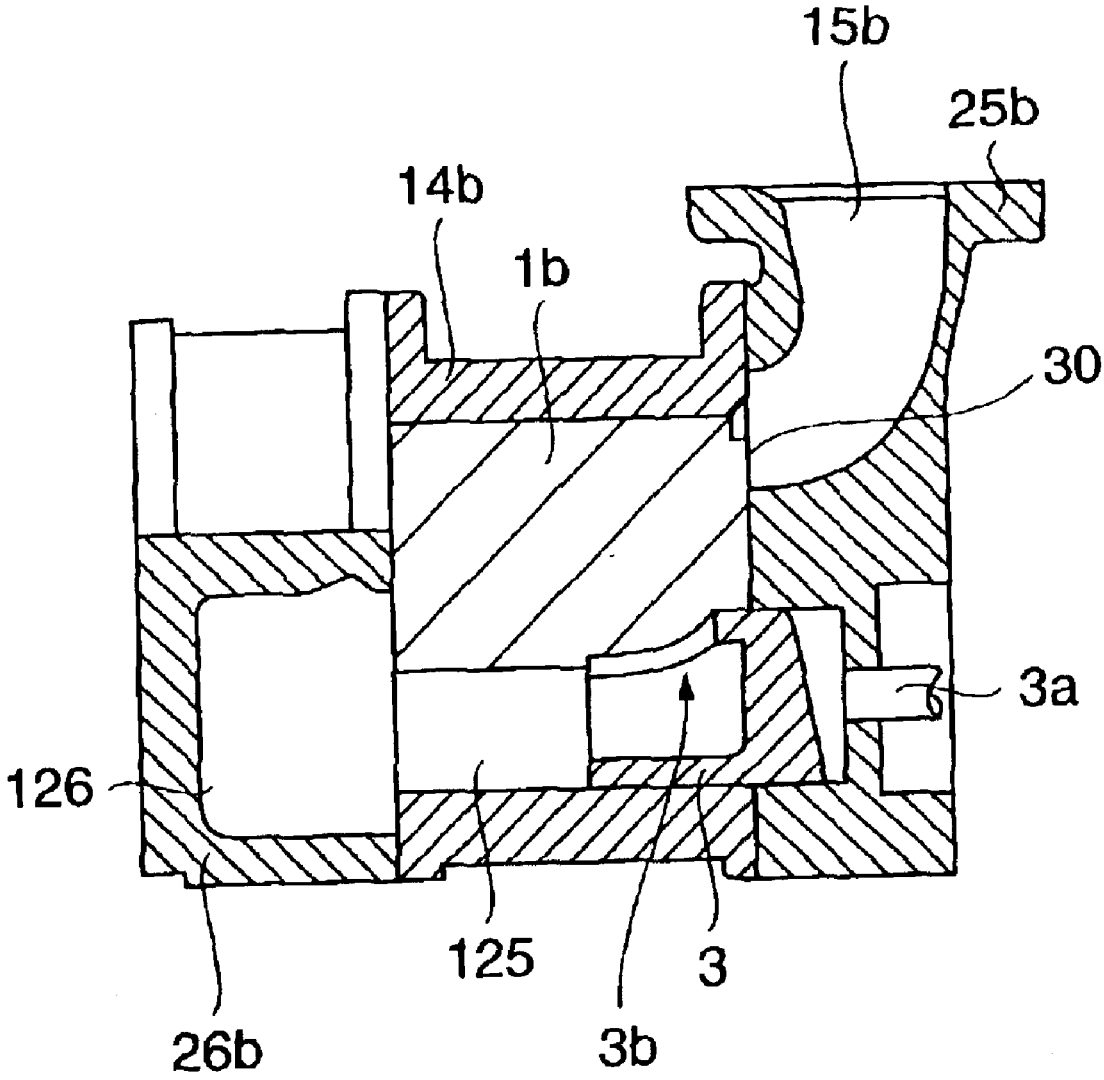
FIG. 2 is a longitudinal sectional view of the higher pressure stage of the compressor of FIG. 1 for showing the location of the internal volume ratio control valve.

FIG. 2 is a longitudinal sectional view of the higher pressure stage for showing the location of the internal volume ratio control valve. The working of the internal volume ratio control valve is detailed in the specification of U.S. application Ser. No. 09/783,133 by the present applicant, and will be briefly explained here.

The internal volume ratio control valve 3 can be moved by the driving part (not shown in the drawing) of the internal volume ratio control valve 3 in the longitudinal direction of the shaft of the rotor 1*b* by the medium of the control shaft 3*a* connected to the right end of the control valve 3 The control valve 3 has a cut-out part 3*b* formed in the left end side thereof.

The gas sucked from the suction port 15*b* into the space between teeth as the rotor 1*b* rotates is enclosed in the space between teeth when the communication of the space with the suction port is shut off as the rotor 1*b* rotates further.

The enclosed space between teeth proceeds toward the discharge side reducing the volume as the rotor 1*b* rotates further. When the enclosed space between teeth reaches said cut-out part, the enclosed space between teeth begins to communicate with the discharge space 126 by way of the space under the rotor 1*b*.

The nearer the control valve 3 is moved toward the discharge side end of the rotor 1*b*, the communication of the enclosed space between teeth with the discharge space 126 happens at the position nearer to the discharge side end of the rotor 1*b*. As the volume of the enclosed space between teeth decreases as it proceeds toward the discharge side, the gas in the enclosed space between teeth is compressed to higher pressure to be discharged into the discharge space 126. Accordingly, the compression ratio is increased. The control valve 3 is located so that its suction side end face 3*d* is not allowed to move to the left beyond the suction side end face 30 of the rotor 1*b*.

Figure 3:
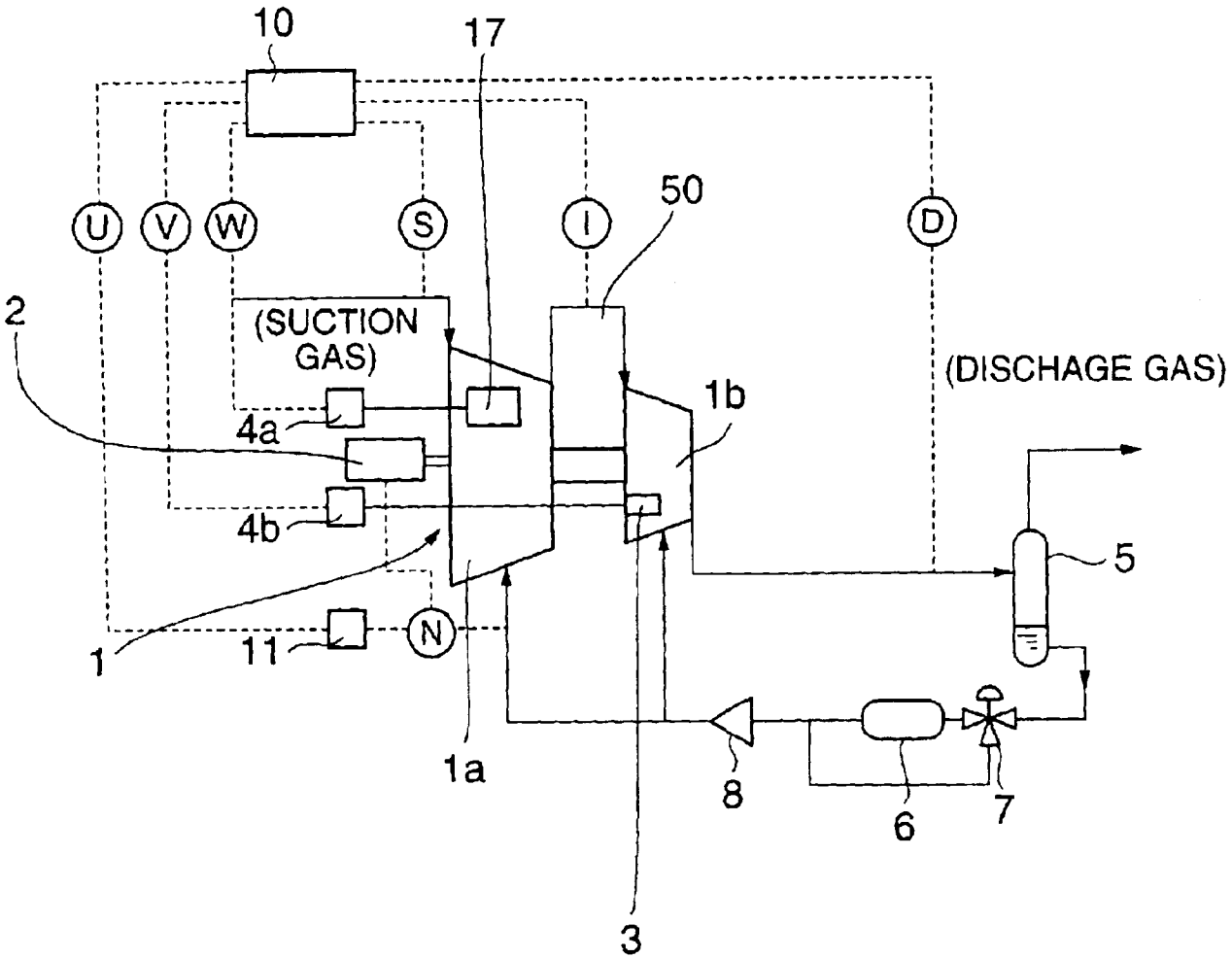
FIG. 3 is a block diagram of the 2-stage compound screw compressor unit accommodating pressure fluctuations according to the present invention in the case the lower pressure stage is provided with an unloader slide valve.

FIG. 3 is a block diagram of the 2-stage compound screw compressor unit accommodating pressure fluctuations according to the present invention in the case the lower pressure stage is provided with an unloader slide valve. In the drawing, the 2-stage compound screw compressor 1 consists of a lower pressure stage 1*a* and a higher pressure stage 1*b*. The lower pressure stage 1*a* is provided with an unloader slide valve 17, and the higher pressure stage 1*b* is provided with an internal volume ratio control valve 3.

These valves are slidable by a valve driving part 4*a* and 4*b* respectively. The compressor 1 is driven by a driving machine 2.

The gas compressed in the lower pressure stage 1*a* is sucked into the higher pressure stage 1*b* via an intermediate passage 50. The gas discharged from the higher pressure stage 1*b* is introduced to an oil separator 5 where the lubrication oil mixed in the gas is separated, and the gas with the oil separated is supplied to where needed.

The oil separated in the oil separator 5 and accumulated in the lower part of the separator 5 is supplied to the compressor 1 for the lubrication of the rotors and bearings via an oil pump 8 by way of an oil cooler 6. The oil lubricated the rotors and bearings is discharged together with the gas, separated from the gas in the oil separator 5 to be re-circulated. The temperature of the oil which bypassing said oil cooler 6 is controlled by adjusting the flow rate of the oil by means of a valve 7 for adjusting oil temperature.

Signals S including the kind, pressure, and temperature of suction gas, signals I including the intermediate pressure and temperature of the gas, signals D including the pressure and temperature of the discharge gas from the higher pressure stage, and signal N indicating the rotation speed of the driving machine 2 are sent to a calculation and control part 10. Although the signals D is detected from the discharge gas mixed with lubrication oil in the drawing, they may be detected in the oil separator 5 or at the outlet of the gas from the separator 5. Said calculation and control part 10 calculates polytropic exponent based on the detected pressures and temperatures (polytropic exponent varies depending on the condition of compression, particularly on cooling condition which is influenced by the pressure and temperature of gas in addition to being dependent on the kind of gas), determines the internal volume ratio with which the polytropic efficiency of compression is maximum, and sends a signal V to the internal volume ratio control valve driving means 4*b* for allowing it to move the internal volume ratio control valve 3 to the position with which the polytropic efficiency is maximum.

Signal W is the signal for driving the unloader slide valve 17 of the lower pressure stage. In the case the lower pressure stage is provided with an internal volume ratio control valve 3', signal W is the signal for driving the internal volume ratio control valve 3' of the lower pressure stage.

The unloader slide valve 17 and the internal volume ratio control valve 3 may be slid by means of a hydraulic device or by means of a step motor by converting the rotation thereof into linear motion. The detection of the position of these valves may be performed by means of a linear position detector or by detecting the rotation angle of said step motor.

When capacity control, i.e. flow rate control is performed by controlling the rotation speed of the driving machine 2, signal U is sent from the calculation and control part 10 to a driving machine rotation speed controller 11 to control the rotation speed of the driving machine 2. The transmission line of signal U and that of signal N is represented by a single line in the drawing.

An inverter motor or an engine with transmission gearbox may be used as the driving machine 2. Particularly, by using an inverter motor which controls rotation speed by varying frequencies, continuous, stepless control of the flow rate of gas is possible.

Figure 4:
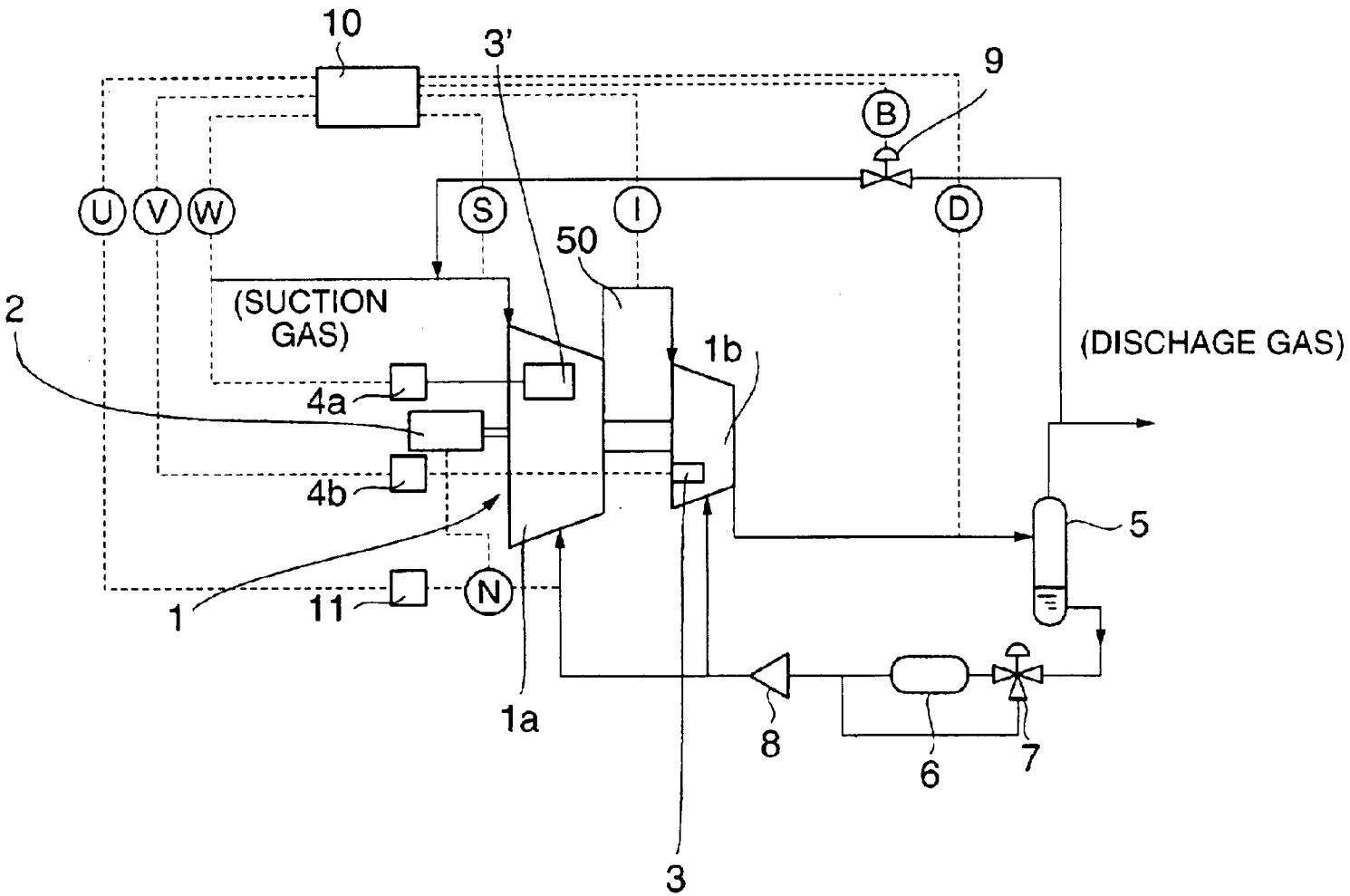
FIG. 4 is a block diagram of the 2-stage compound screw compressor unit accommodating pressure fluctuations according to the present invention in the case the lower pressure stage is provided with an internal volume ratio control valve.

FIG. 4 is a block diagram of the 2-stage compound screw compressor unit accommodating pressure fluctuations according to the present invention I the case the lower pressure stage is provided with an internal volume ratio control valve. In this case, reference numeral 4*a* is a driving means for moving the internal volume ratio control valve 3' of the lower pressure stage. In this embodiment, a bypass passage having a bypass control valve 9 is provided for connecting the discharge side of the higher pressure stage with the suction side of the lower pressure stage. Although both the lower and higher pressure stages are provided with an internal volume ratio control valves 3' and 3 respectively in the drawing, the internal volume ratio control valve 3 of the higher pressure stage may be omitted depending on applications, which means that the higher pressure stage is of constant internal volume ratio.

When flow rate control is performed by said bypass control valve 9, the control is performed by sending signal B from the calculation and control part 10 to the bypass control valve 9. The control of the rotation speed of driving machine and the control of the bypass control valve may be performed concurrently for controlling the flow rate of gas.

Particularly, when the rotation speed must be decreased to extreme low speed for decreasing the flow rate to an extreme small value, wear and tear or damage may occur in bearings due to insufficient thickness of lubrication film owing to low rotation speed. To evade this problem, it is preferable to perform the flow rate control by means of the bypass control valve 9 while maintaining the rotation speed at a certain low speed.

Figure 5:
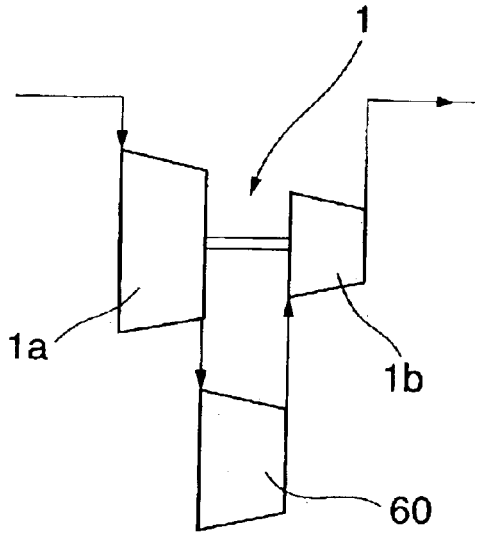
FIG. 5(A) is a schematic representation of a modification of the multi-stage screw compressor units in the case a single-stage screw compressor is provided between the lower and higher pressure stage of the 2-stage compound screw compressor according to the present invention.
FIG. 5(B) is that in the case a two-stage screw compressor is provided between the lower and higher pressure stage of the 2-stage compound screw compressor according to the present invention.
Figure 5:
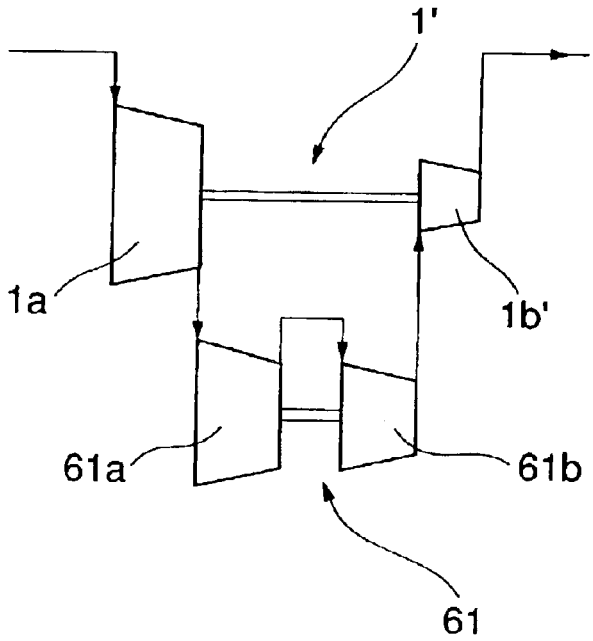
Figure 6:
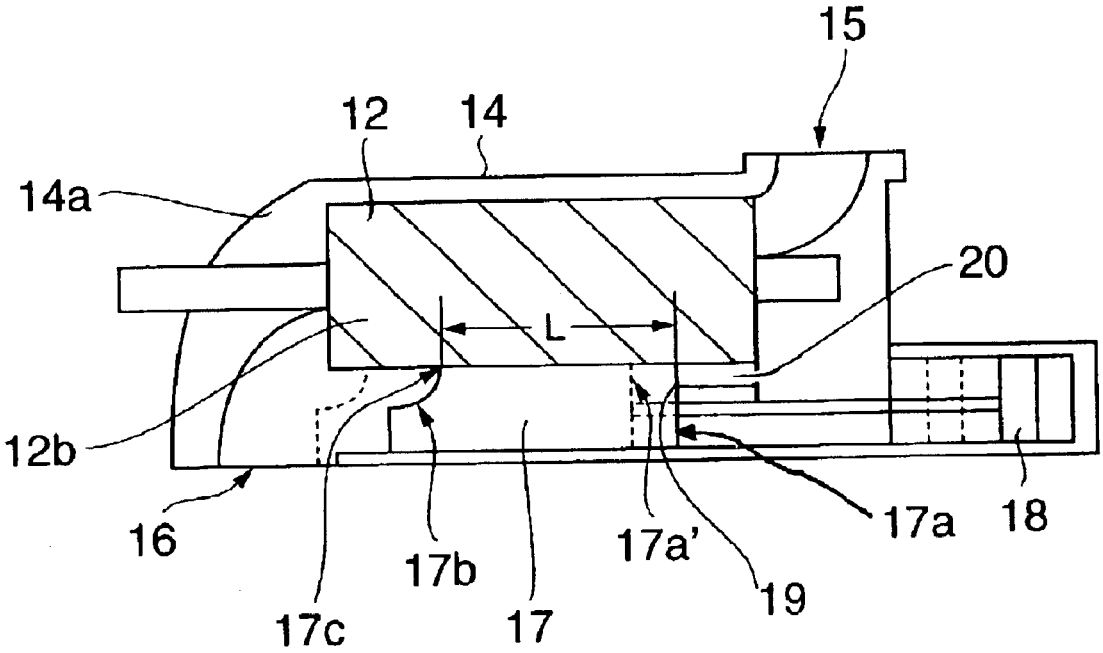
FIG. 6 is a schematic representation of a conventional screw compressor having an unloader slide valve.

FIG. 5(A) is a schematic representation of a modification of the multi-stage screw compressor units in the case a single-stage screw compressor is provided between the lower and higher pressure stage of the 2-stage compound screw compressor according to the present invention, and FIG. 5(B) is in the case a two-stage screw compressor is provided between the lower and higher pressure stage of the 2-stage compound screw compressor according to the present invention.

In FIG. 5(A), a single-stage screw compressor 60 is provided between the discharge port of the lower pressure stage and the suction port of the higher pressure stage of the two-stage compound screw compressor 1 consisting of a lower pressure stage 1*a* and a higher pressure stage 1*b* according to the present invention. In FIG. 5(A), the gas sucked into the lower pressure stage 1*a* is compressed therein and discharged therefrom, then sucked into the single-stage compressor 60 to be further compressed and discharged therefrom, the gas discharged from the compressor 60 is sucked into the higher pressure stage 1*b* to be yet further compressed and discharged.

In FIG. 5(B), a two-stage screw compressor 61 is provided between the discharge port of the lower pressure stage 1*a* and the suction port of the higher pressure stage 1*b'* of the two-stage compound screw compressor 1' consisting of a lower pressure stage 1*a* and a higher pressure stage 1*b'* according to the present invention. The flow and compression of gas can be easily understood by the drawing.

These compositions of compressors are suitable when the suction pressure of the lower pressure stage 1*a* is very low, for example, when applied in use for vacuum pomp. The single-stage compressor 60 and two-stage compressor 61 may be of constant internal volume ratio.

It is also suitable to provide a single-stage compressor or a two-stage compressor upstream or downstream from the two-stage compound screw compressor of the invention.

As has been described in the foregoing, according to the present invention, a multi-stage compound screw compressor unit is provided and operated while always maintaining high efficiency when it is necessary to compose a compressor in multi-stage compression type to attain high compression ratio, even when suction pressure fluctuates widely with nearly constant discharge pressure or even when both suction and discharge pressures fluctuate widely, for example, when the compressor is used in the following applications:

1. Refrigeration, air conditioning: High compression ratio is required in summer and compression ratio decreases in winter as condensation temperature decreases in winter. In some case suction pressure is high depending on the kind of refrigerant and operation condition.
2. Gas turbine booster: Suction pressure fluctuates. In some case suction pressure is high and compression ratio decreases.
3. Pressurized transportation of natural gas: Gas pressure spouting from gas field always vanes.
4. Pressurizing of chemical process gas: The kind of gas and compression ratio are changed when operation pattern is changed.
5. Pressurized transfer of gas to a spherical holder: At first the compressor is operated with low compression ratio, but higher compression ratio is required as the gas filled in the spherical holder increases.

To be more specific, by composing the two-stage compound compressor unit of the present invention such that the lower pressure stage is provided with an unloader slide valve and the higher pressure stage is provided with an internal volume ratio control valve capable of varying internal volume ratio from near 1.0 to the ratio corresponding to required discharge pressure, the compressor unit can be operated always with high efficiency even when suction pressure is high or fluctuates widely and discharge pressure is nearly constant. By composing the compressor unit such that the rotation speed of the compressor is variable, it may be adapted to the use when the flow rate of gas widely fluctuates. This means that the compressor unit can accommodate the small fluctuation of flow rate by the control of the unloader slide valve of the low pressure stage, and can accommodate the big fluctuation of flow rate by the control of the rotation speed of the compressor.

By composing the compressor unit such that the higher pressure stage is provided with an internal volume ratio control valve capable of varying internal volume ratio from near 1.0 to the ratio corresponding to required discharge pressure and the lower pressure stage is of constant internal volume ratio, the compressor unit can be operated always with high efficiency even when suction pressure is high or fluctuates widely and discharge pressure is nearly constant. In this case, flow rate control is performed by controlling the rotation speed of the compressor.

By composing the compressor unit such that each of both the lower and higher pressure stage is provided with an internal volume ratio control valve capable of varying internal volume ratio from near 1.0 to the ratio corresponding to required discharge pressure and the rotation speed of the compressor is variable, the compressor unit can be operated always with high efficiency even when suction and discharge pressure fluctuate and when suction pressure is nearly constant or high and discharge pressure fluctuates.

By connecting the discharge port of the higher pressure stage with the suction port of the lower pressure stage by way of control valve and controlling the bypass valve, flow rate control at low rotation speed of the compressor can be performed smoothly without inducing wear and tear or damage in the bearings.

By providing a single-stage or two-stage compressor between the discharge port of the lower pressure stage and the suction port of the higher pressure stage of the multi-stage compound compressor unit of the present invention, adaptation particularly to vacuum pumping in which suction pressure is low, is possible. In this case, the single-stage or multi-stage compressor may be of constant internal volume ratio.

Further, by starting with the internal volume ratio control valve or valves are moved to the positioned so that internal volume ratio is minimum near 1.0, starting torque is reduced.

What is claimed is:

1. A compressor unit in use for accommodating fluctuation of suction and discharge pressure, the compressor being composed as a two-stage compound compressor in which the lower and higher pressure stages have the same axis of rotation, wherein the lower pressure stage is provided with an unloader slide valve or an internal volume ratio control valve capable of varying internal volume ratio from near 1.0 to the ratio corresponding to a required discharge pressure at a lower pressure stage outlet, the higher pressure stage is provided with an internal volume ratio control valve capable of varying internal volume ratio from near 1.0 to the ratio corresponding to a required discharge pressure at a higher pressure stage outlet or is of constant internal volume ratio, and the driving machine of said compressor is of variable rotation speed or of constant rotation speed depending on applications.

2. The compressor unit according to claim 1, wherein the higher pressure stage is provided with an internal volume ratio control valve capable of varying internal volume ratio from near 1.0 to the ratio corresponding to the required discharge pressure at the higher pressure stage outlet when the lower pressure stage is provided with the unloader slide valve.

3. The compressor unit according to claim 1, wherein the lower pressure stage is of constant internal volume ratio when the higher pressure stage is provided with the internal volume ratio control valve capable of varying internal volume ratio from near 1.0 to the ratio corresponding to the required discharge pressure at the higher pressure stage outlet.

4. The compressor unit according to claim 1, wherein each of the lower and higher pressure stages is provided with the internal volume ratio control valve capable of varying internal volume ratio from near 1.0 to the ratio corresponding to the required discharge pressure at their respective pressure stage outlets.

5. The compressor unit according to claim 1, wherein the discharge port of the higher pressure stage is connected with the suction port of the lower stage by way of a bypass control valve.

6. The compressor unit according to claim 1, wherein the compressor unit of which the higher pressure stage is provided with an internal volume ratio control valve capable of varying internal volume ratio from near 1.0 to the ratio corresponding to the required discharge pressure at the higher pressure stage outlet according to claim 1 is provided with a calculation part which calculates polytropic exponent according to operation conditions such as the kind of gas, pressure and temperature of gas, and rotation speed and determines the internal volume ratio with which polytropic efficiency is maximum, and a control part for moving the internal volume ratio control valve to the position with which polytropic efficiency is maximum and fix the valve there.

7. The compressor unit according to claim 1, wherein a or plurality of single-stage or two-stage compressors are provided between the discharge port of the lower pressure stage and the suction port of the higher pressure stage.

8. A method of operating a compressor unit composed as a two-stage compound compressor in which the lower and higher pressure stages have the same axis of rotation, the lower pressure stage being provided with an unloader slide valve or an internal volume ratio control valve capable of varying internal volume ratio from near 1.0 to the ratio corresponding to a required discharge pressure at a lower pressure stage outlet, the higher pressure stage being provided with an internal volume ratio control valve capable of varying internal volume ratio from near 1.0 to the ratio corresponding to a required discharge pressure at a higher pressure stage outlet or is of constant internal volume ratio, the driving machine of said compressor being of variable rotation speed or of constant rotation speed depending on application purpose, wherein the two-stage compound compressor unit of which the discharge port of the higher pressure stage is connected with the suction port of the lower stage by way of a bypass control valve is used, flow rate control is performed by controlling the rotation speed of the compressor in normal operation, and flow rate control is performed by controlling the opening of the bypass control valve when operating at extremely low rotation speed at which troubles may occur in bearing lubrication.

9. A method of operating a compound multi-stage compressor unit having a compression stage or stages provided with the internal volume ratio control valve or valves capable of varying internal volume ratio from near 1.0 to the ratio corresponding to a required discharge pressure at an outlet of each pressure stage provided with said control valve or valves, wherein the compressor unit is started with the internal volume ratio control valve or valves moved to the position with which internal volume ratio of the stage or stages provided with the valve or valves is minimum near 1.0.

* * * * *